US010233586B2

(12) United States Patent
Jang et al.

(10) Patent No.: US 10,233,586 B2
(45) Date of Patent: Mar. 19, 2019

(54) CONTROL METHOD OF LAUNDRY TREATMENT APPARATUS

(71) Applicant: LG ELECTRONICS INC., Seoul (KR)

(72) Inventors: Jaehyuk Jang, Seoul (KR); Youngho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 200 days.

(21) Appl. No.: 14/766,481

(22) PCT Filed: Dec. 3, 2014

(86) PCT No.: PCT/KR2014/011769

§ 371 (c)(1),
(2) Date: Aug. 7, 2015

(87) PCT Pub. No.: WO2016/088914

PCT Pub. Date: Jun. 9, 2016

(65) Prior Publication Data

US 2016/0340819 A1 Nov. 24, 2016

(51) Int. Cl.

| | |
|---|---|
| ***D06F 39/04*** | (2006.01) |
| ***D06F 33/00*** | (2006.01) |
| ***D06F 35/00*** | (2006.01) |
| ***D06F 33/02*** | (2006.01) |
| *D06F 39/08* | (2006.01) |

(52) U.S. Cl.

CPC ..... *D06F 39/04* (2013.01); *D06F 33/00* (2013.01); *D06F 33/02* (2013.01); *D06F 35/006* (2013.01); *D06F 39/045* (2013.01); *D06F 39/08* (2013.01)

(58) Field of Classification Search

CPC ..... D06F 39/04

See application file for complete search history.

(56) References Cited

U.S. PATENT DOCUMENTS

| | | | |
|---|---|---|---|
| 2007/0062061 | A1 | 3/2007 | Carow |
| 2012/0047661 | A1 | 3/2012 | Hong et al. |
| 2013/0318724 | A1 | 12/2013 | Wong |

(Continued)

FOREIGN PATENT DOCUMENTS

| | | |
|---|---|---|
| CN | 1928194 | 3/2007 |
| CN | 201261843 | 6/2009 |
| CN | 101701411 | 5/2010 |

(Continued)

OTHER PUBLICATIONS

Kim et al., Sep. 2007, KR 10-2006-0021488, English machine translation.*

(Continued)

*Primary Examiner* — Jason Y Ko

(74) *Attorney, Agent, or Firm* — Ked & Associates, LLP

(57) ABSTRACT

Disclosed is a control method of a laundry treatment apparatus, including a first heating step of heating wash water stored in a tub by operating all of at least two heaters included in the laundry treatment apparatus, a heating end step of ending the first heating step when the temperature of the wash water reaches a predetermined reference temperature, and a second heating step of alternately operating the heaters when the temperature of the wash water falls down below the reference temperature.

10 Claims, 4 Drawing Sheets

(56) References Cited

U.S. PATENT DOCUMENTS

2014/0033559 A1 2/2014 Bellinger et al.

FOREIGN PATENT DOCUMENTS

| | | | |
|---|---|---|---|
| CN | 101805975 | | 8/2010 |
| JP | 2008-289680 | A | 12/2008 |
| KR | 10-2007-0091848 | A | 9/2007 |
| KR | 10-2008-0057720 | | 6/2008 |
| KR | 10-2009-0079560 | A | 7/2009 |
| WO | WO 2010/128727 | | 11/2010 |

OTHER PUBLICATIONS

International Search Report and Written Opinion dated Aug. 3, 2015 issued in Application No. PCT/KR2014/011769.
Chinese Office Action dated Mar. 20, 2017 issued in Application No. 201480006811.0 (English translation attached).
European Search Report dated Jun. 6, 2018 issued in Application No. 14885849.1.

* cited by examiner

CONTROL METHOD OF LAUNDRY TREATMENT APPARATUS

CROSS-REFERENCE TO RELATED PATENT APPLICATION

This application is a U.S. National Stage Application under 35 U.S.C. § 371 of PCT Application No. PCT/KR2014/011769, filed Dec. 3, 2014, whose entire disclosure is hereby incorporated by reference.

TECHNICAL FIELD

The present invention relates to a control method of a laundry treatment apparatus.

BACKGROUND ART

A laundry treatment apparatus refers to an apparatus that washes laundry using friction between a drum and the laundry and friction between the laundry and wash water stored in a tub by rotating the drum placed inside the tub, or that dries laundry stored in a drum.

A conventional laundry treatment apparatus that enables washing of laundry includes a tub in which wash water is stored and a drum in which laundry is stored, the drum being rotatably installed inside the tub. The laundry treatment apparatus is adapted to wash laundry using heated wash water (hot water) and includes a heating device to heat the wash water inside the tub.

The conventional laundry treatment apparatus as described above takes a long time to heat wash water to a desired temperature because the wash water must be heated using a single heating device, which problematically increases the time taken by a so-called hot water course (i.e. a course to wash laundry using hot water).

In addition, the conventional laundry treatment apparatus may cause overheating of the heating device when a great quantity of electric power is supplied to the heating device in order to reduce the heating time.

In addition, in the conventional laundry treatment apparatus, when the on/off period of the heating device is reduced to prevent overheating, the lifespan of the heating device as well as that of a switch provided for the control of the heating device may be reduced.

DISCLOSURE

Technical Problem

One object of the present invention is to provide a control method of a laundry treatment apparatus which is capable of rapidly heating wash water and preventing an increase in the time taken by a hot water course.

In addition, another object of the present invention is to provide a control method of a laundry treatment apparatus which is capable of reducing electric power consumption.

In addition, a further object of the present invention is to provide a control method of a laundry treatment apparatus which is capable of preventing a reduction in the lifespan of a heating device to heat wash water and a switch to control the operation of the heating device included in the laundry treatment apparatus.

Technical Solution

The object of the present invention can be achieved by providing a control method of a laundry treatment apparatus, the laundry treatment apparatus including a tub configured to provide a space for storage of wash water, at least two heaters configured to heat the wash water, and a temperature sensing unit configured to sense a temperature of the wash water stored inside the tub, the control method including a first heating step of heating the wash water stored in the tub by supplying electric power to all of the heaters, a heating end step of ending the first heating step when the temperature of the wash water measured by the temperature sensing unit reaches a predetermined reference temperature, and a second heating step of heating the wash water by alternately supplying electric power to the heaters when the temperature of the wash water measured by the temperature sensing unit falls down below the reference temperature.

The first heating step, the heating end step, and the second heating step may be performed via control of switches configured to connect the respective heaters to a power supply.

The control method may further include a course time setting step of setting an implementation time (course time) of a hot water course, the hot water course including the first heating step and the heating end step, and the second heating step may be performed in the case where the sum of a time taken in the first heating step and a time taken in the heating end step is shorter than the course time.

The reference temperature may include a first reference temperature and a second reference temperature set to be lower than the first reference temperature, the heating end step may be initiated when the temperature of the wash water reaches the first reference temperature, and the second heating step may be initiated when the temperature of the wash water is lower than the second reference temperature.

The second heating step may be performed as electric power is supplied to one heater for a predetermined reference time when a time during which electric power is supplied to the other heater reaches the reference time.

The second heating step may include a first heater operating step of supplying electric power to only one heater among the heaters, a step of ending the first heater operating step when the temperature of the wash water reaches the first reference temperature or when a time taken in the first heater operating step reaches a predetermined reference time, a second heater operating step of supplying electric power to only the other heater among the heaters, and a step of ending the second heater operating step when the temperature of the wash water reaches the first reference temperature or when a time taken in the second heater operating step reaches the reference time.

In the case where the first heater operating step ends as the temperature of the wash water reaches the first reference temperature, the second heater operating step may be initiated when the temperature of the wash water reaches the second reference temperature set to be lower than the first reference temperature.

In the case where the heaters include a first heater and a second heater, the first heating step may be a step of heating the wash water stored in the tub by simultaneously operating the first heater and the second heater, and the second heating step may be a step of heating the wash water by alternately operating the first heater and the second heater.

In accordance with another aspect of the present invention, there is provided a control method of a laundry treatment apparatus, the laundry treatment apparatus including a tub configured to provide a space for storage of wash water, a first heater and a second heater configured to heat the wash water, and a temperature sensing unit configured to sense a temperature of the wash water stored inside the tub, the control method including a first heating step of heating the wash water stored in the tub by operating the first heater and the second heater, a heating end step of ending the first heating step when the temperature of the wash water measured by the temperature sensing unit reaches a predetermined reference temperature, and a second heating step of heating the wash water by alternately operating the first heater and the second heater when the temperature of the wash water measured by the temperature sensing unit falls down below the reference temperature.

The control method may further include a course time setting step of setting an implementation time of a hot water course, the hot water course including the first heating step and the heating end step, and the second heating step may be performed in the case where the sum of a time taken in the first heating step and a time taken in the heating end step is shorter than a course time set in the course time setting step.

The reference temperature may include a first reference temperature and a second reference temperature set to be lower than the first reference temperature, the heating end step may be initiated when the temperature of the wash water reaches the first reference temperature, and the second heating step may be initiated when the temperature of the wash water is lower than the second reference temperature.

The second heating step may include a first heater operating step of operating only the first heater, a step of ending the first heater operating step when the temperature of the wash water reaches the predetermined first reference temperature or when a time taken in the first heater operating step reaches a predetermined reference time, a second heater operating step of operating only the second heater, and a step of ending the second heater operating step when the temperature of the wash water reaches the first reference temperature or when a time taken in the second heater operating step reaches the reference time.

In the case where the first heater operating step ends as the temperature of the wash water reaches the first reference temperature, the second heater operating step may be initiated when the temperature of the wash water reaches the second reference temperature set to be lower than the first reference temperature.

Advantageous Effects

The present invention may achieve the effect of providing a control method of a laundry treatment apparatus which is capable of rapidly heating wash water and preventing an increase in the time taken by a hot water course.

In addition, the present invention may achieve the effect of providing a control method of a laundry treatment apparatus which is capable of reducing electric power consumption.

In addition, the present invention may achieve the effect of providing a control method of a laundry treatment apparatus which is capable of preventing a reduction in the lifespan of a heating device to heat wash water and a switch to control the operation of the heating device included in the laundry treatment apparatus.

BEST MODE

Figure 1:
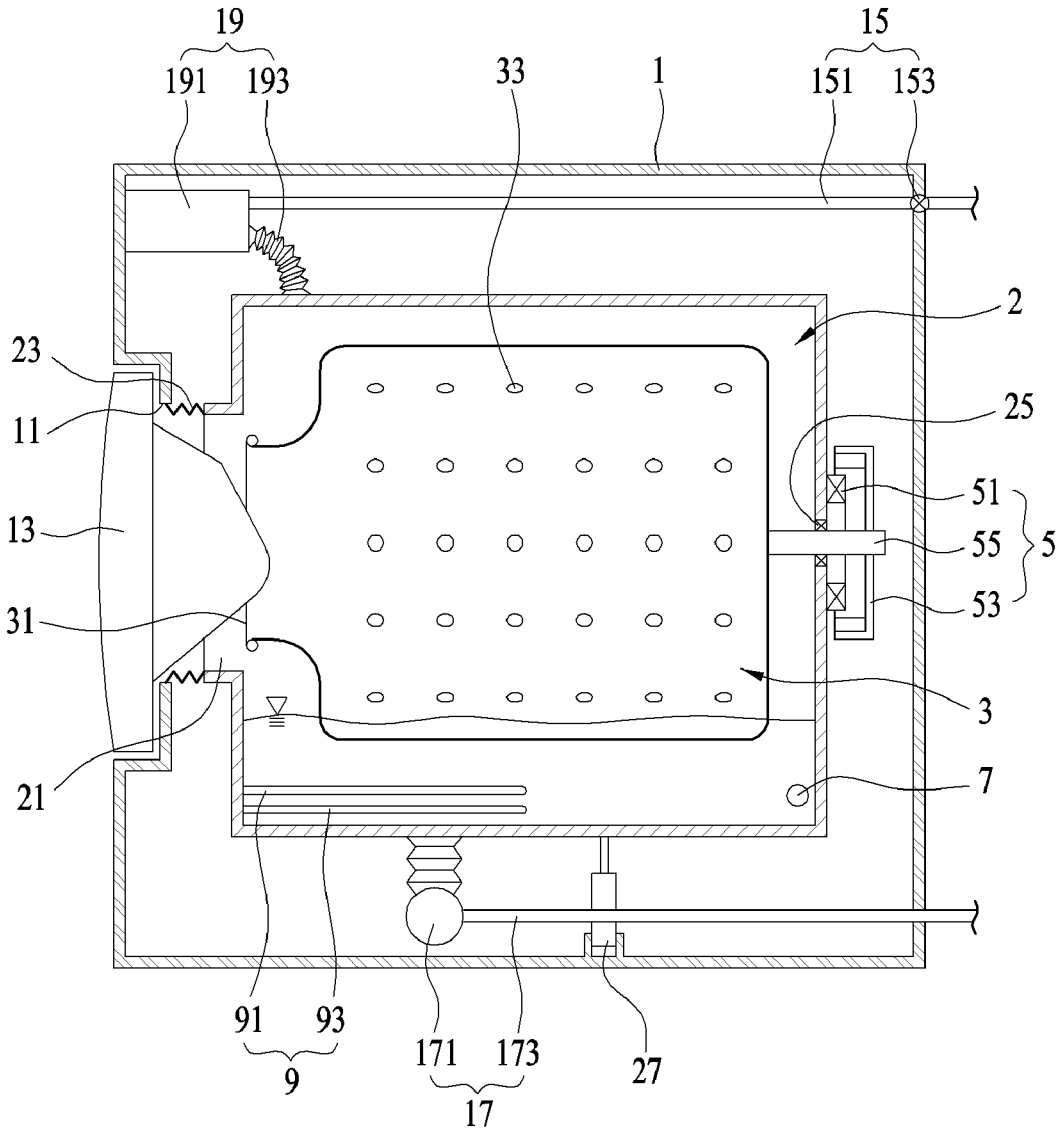
FIGS. 1 and 2 illustrate a laundry treatment apparatus according to the present invention.

Hereinafter, exemplary embodiments of the present invention will be described in detail with reference to the accompanying drawings. The configuration or control method of an apparatus to be described below are intended to explain the embodiments of the present invention and are not intended to limit the scope of the present invention. The same elements are designated by the same reference numerals throughout the specification.

A laundry treatment apparatus 100 of the present invention includes a cabinet 1 defining the external appearance of the apparatus, a tub 2 provided inside the cabinet, a drum 3 in which laundry is received, the drum being rotatably provided inside the tub, and a drive unit 5 to rotate the drum.

The cabinet 1 includes an opening 11 for introduction and removal of laundry and a door 13 to open or close the opening 11.

The tub 2 serves to provide a space in which wash water can be stored. The tub includes a tub opening 21 in communication with the opening 11. The tub 2 is fixed inside the cabinet 1 by a tub support member 27.

The tub support member 27 serves to attenuate vibration generated in the tub by, for example, a damper or a spring.

A gasket 23 may be provided between the opening 11 and the tub opening 21. The gasket 23 serves to prevent wash water inside the tub 2 from leaking to the cabinet 1. When the gasket is formed of an elastic material, the gasket may prevent vibration of the tub 2 from being transmitted to the cabinet 1.

Meanwhile, the cabinet 1 may further include a water supply unit 15 to supply wash water to the tub 2 and a drain unit 17 to discharge wash water inside the tub to the outside of the cabinet 1.

The water supply unit 15 may include a water supply hose 151 that connects a water supply source (not illustrated) and the tub 2 to each other and a water supply valve 153 to open or close the water supply hose. The drain unit 17 may include a drain hose 173 to communicate the tub 2 to the outside of the cabinet and a drain pump 171 provided at the drain hose.

In addition, the cabinet 1 may further include a detergent supply unit 19 to supply detergent to the tub 2.

The detergent supply unit 19 is retractable from the front surface of the cabinet 1 (provided with the opening). The detergent supply unit may include a drawer 191 connected to the water supply hose 151 and a connection pipe 193 connecting the drawer 191 and the tub 2 to each other.

Accordingly, when wash water is supplied through the water supply hose 151, detergent stored in the drawer 191 may be supplied to the tub 2 through the connection pipe 193.

The drum 3 includes a drum opening 31 in communication with the tub opening 21. As such, the user can introduce laundry to the drum 3 through the opening, the tub opening, and the drum opening, or may remove the laundry from the interior of the drum 3.

In addition, the drum 3 includes a plurality of through-holes 33 perforated in the outer circumferential surface thereof. This serves to allow the wash water stored in the tub 2 to be introduced to the drum or to allow water removed from the laundry to be discharged to the tub.

The drum 3 is rotated by the drive unit 5 that is located at the outside of the tub 2.

The drive unit 5 may include a stator 51 fixed to the rear surface of the tub 2, a rotor 53 configured to be rotated via electromagnetic interaction with the stator, and a rotating shaft 55 penetrating the rear surface of the tub 2 to connect the drum 3 and the rotor 53 to each other.

Since the rotating shaft 55 penetrates the rear surface of the tub 2, the tub 2 may further include a rotating shaft support member (25, for example, a bearing) to rotatably support the rotating shaft 55.

Meanwhile, a heating device 9 to heat the wash water stored in the tub and a temperature sensing unit 7 to measure the temperature of the wash water stored in the tub may be provided inside the tub 2.

The controller 6 may judge the temperature of wash water based on data provided by the temperature sensing unit 7 and control the on/off operation of the heating device 9 based on the temperature data of the wash water.

The heating device 9 may include at least two heaters and each heater may be connected to a power supply 8 via a switch (provided equal in number to the heater).

Figure 2:
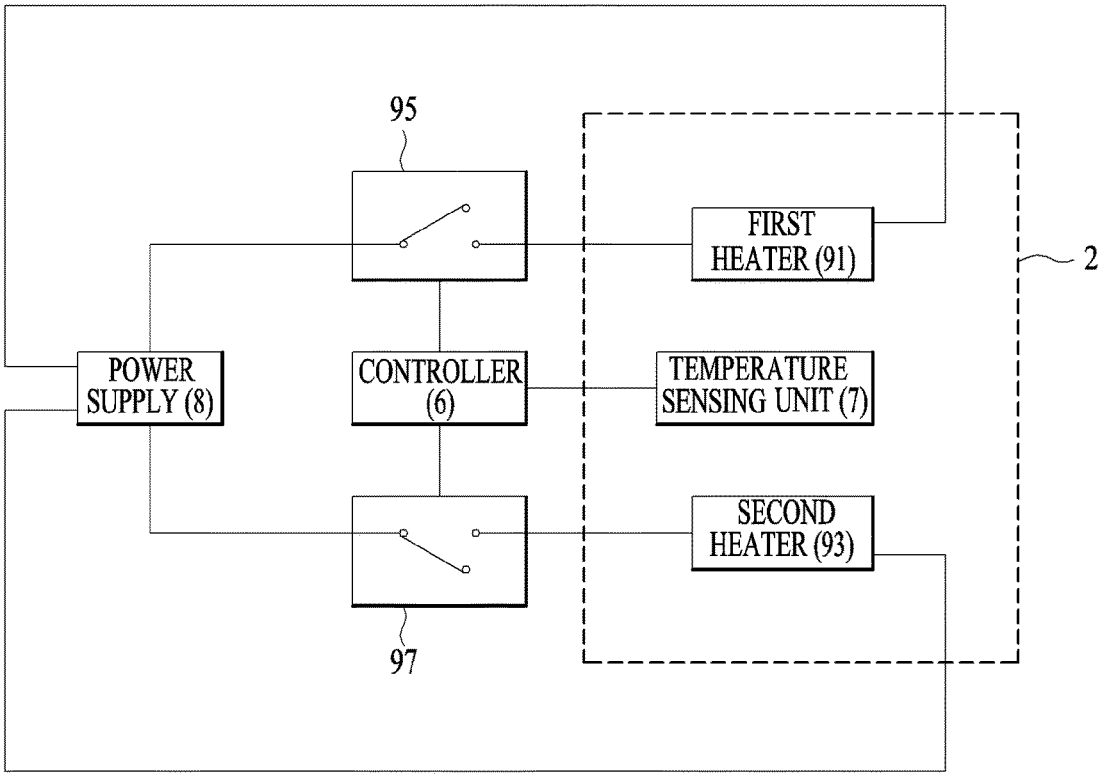

FIGS. 1 and 2 illustrate the case where the heating device 9 includes a first heater 91 and a second heater 93 by way of example. For convenience of description, the following description will focus on the case where two heaters are provided.

The first heater 91 and the second heater 93 may be located inside the tub 2. In this case, the heaters 91 and 93 are arranged at positions at which the heaters can heat the wash water even in the case where the wash water is supplied to the minimum water level, chosen from among the maximum water level and the minimum water level set in the laundry treatment apparatus 100.

The term "maximum water level" means the quantity of wash water set to be supplied to the tub when the maximum quantity of laundry that can be washed by the laundry treatment apparatus is introduced to the drum, and the term "minimum water level" means the quantity of water set to be supplied to the tub when the minimum quantity of laundry that can be washed by the laundry treatment apparatus is introduced to the drum.

Meanwhile, the first heater 91 is connected to the power supply 8 via a first switch 95 and the second heater 93 is connected to the power supply 8 via a second switch 97. The controller 6 controls the respective switches 95 and 97 to supply electric power to the respective heaters 91 and 93 for heating the wash water.

Figure 3:
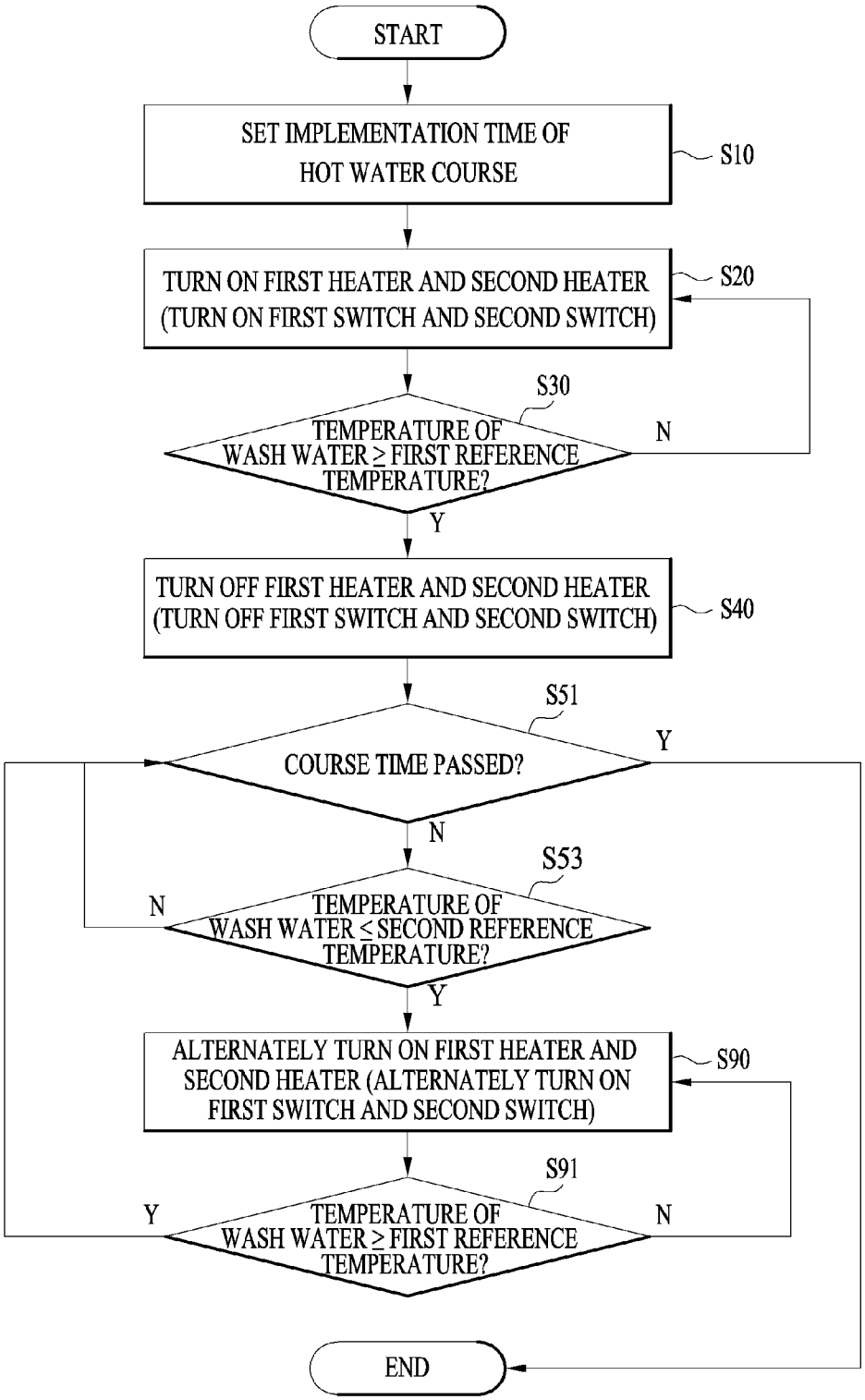
FIG. 3 illustrates a control method of a laundry treatment apparatus according to the present invention.

Hereinafter, a control process of the laundry treatment apparatus according to the present invention will be described with reference to FIG. 3.

A control method of the laundry treatment apparatus according to the present invention includes a first heating step S20 of heating wash water stored in the tub 2 by operating all of the heaters provided to heat the wash water, a heating end step S40 of ending the first heating step (stopping operation of all of the heaters) when the temperature of the wash water reaches a predetermined reference temperature (S30), and a second heating step S90 of heating the wash water by alternately operating the heaters provided in the laundry treatment apparatus when the temperature of the wash water falls down below the reference temperature (S53) after the first heating step ends (S40).

For convenience of description, in the following description based on the case where the heating device 9 includes the first heater 91, the second heater 93, the first switch 95 and the second switch 97, the first heating step S20 is a step in which the controller 6 controls the first switch 95 and the second switch 97 to connect the first heater 91 and the second heater 93 to the power supply 8.

In the first heating step S20, the controller 6 supplies electric power to all of the heaters 91 and 93 included in the laundry treatment apparatus 100 to heat the wash water and, therefore, the wash water stored in the tub 2 may be heated to a desired temperature within a short time.

The first heating step S20 is performed until the temperature of the wash water reaches the reference temperature a first time (S30).

The second heating step S90 is a step of maintaining the wash water stored in the tub 2 at a constant temperature after the first heating step S20 ends (S40).

That is, the second heating step S90 may be performed when the temperature of the wash water falls down below the reference temperature (S53) after implementation of the heating end step S40.

Meanwhile, the second heating step S90 has a feature in that the respective heaters 91 and 93 are alternately operated (i.e. one heater is not operated while the other heater is operated) rather than being simultaneously operated.

In the second heating step as well as in the first heating step, although operating all of the heaters simultaneously is advantageous from the aspect of increasing the temperature of the wash water to a desired temperature within a short time, a reduction in the lifespan of the heaters and the switches may result.

When the controller 6 controls the switches 95 and 97 to simultaneously supply electric power to all of the heaters 91 and 93, the temperature of the wash water stored in the tub 2 is increased within a short time. The controller 6 repeats the process of cutting the supply of electric power to the heaters when the temperature of the wash water reaches the predetermined reference temperature and resupplying electric power to the heaters when the temperature of the wash water falls down below the reference temperature.

In this way, the control method of heating the wash water by simultaneously operating all of the heaters 91 and 93 as in the first heating step S20 may shorten the on/off period of the switches 95 and 97 and, in turn, the shortened on/off period of the switches 95 and 97 causes a reduction in the lifespan of the switches as well as a reduction in the lifespan of the heaters 91 and 93 that receive electric power according to the on/off period of the switches.

To solve the above-described problem, in the present invention, all of the heaters 91 and 93 are operated in the first heating step S20 to heat the wash water to the reference temperature within a short time, whereas, in the second heating step S90 for maintaining the wash water at a constant temperature, the heaters 91 and 93 are alternately operated to prevent deterioration in the washing performance and a reduction in the lifespan of the heating device 9.

That is, in the second heating step S90, electric power is supplied to any one heater 91 among the two heaters and no electric power is supplied to the other heater 93 (when three or more heaters are provided, two heaters may have the same on/off period and the other heater may be controlled to be turned on when the two heaters are turned off and to be turned off when the two heaters are turned on).

By alternately operating the heaters rather than simultaneously operating all of the heaters, the rate of increase of the temperature of the wash water is reduced compared to the case where all of the heaters are operated, which may result in the increased on/off period of the switches and the increased operating period of the heaters. Accordingly, the present invention is capable of preventing a reduction in the lifespan of the heating device 9.

In addition, even if it is assumed that the rate of increase of the temperature of the wash water when the heaters are alternately operated is substantially equal to the rate of increase of the temperature of the wash water when all of the heaters are operated, the use frequency of the switches or the heaters when the heaters are alternately operated to heat the wash water will be reduced compared to that when all of the heaters are operated to heat the wash water. In this way, the present invention is capable of preventing a reduction in the lifespan of the heating device 9.

Meanwhile, the "reference temperature", which serves as a criterion to determine the implementation time of the first heating time S20 (to determine the initiation time point of the heating end step) and as a criterion to determine the initiation time point of the second heating step S90, may be set to a single temperature, or may be set to a temperature range (temperature zone) having an upper limit value and a lower limit value.

In the latter case, the first heating step S20 may be performed until the temperature of the wash water reaches a preset first reference temperature (S30) (i.e., the heating end step may be initiated when the temperature of wash water reaches the first reference temperature), and the second heating step S90 may be initiated when the temperature of the wash water becomes a second reference temperature or less (S53) (the first reference temperature>the second reference temperature).

In addition, the control method of the present invention may further include a course time setting step S10 of setting the implementation time of a hot water course.

The "hot water course" is a control command set in the laundry treatment apparatus 100 to wash laundry using heated wash water. The hot water course may include the first heating step S10 and the heating end step S40 and the user can select the hot water course using an input unit (for example, buttons (not illustrated)) displayed on a control panel (not illustrated).

That is, the hot water course is a set of time-series control signals of the water supply unit 15, the drain unit 17, the drive unit 5, and the heating device 9 stored in the controller 6. When the user selects the hot water course via the input unit, the controller 6 controls the laundry treatment apparatus 100 in response to the control signals constituting the hot water course (for example, signals to control the water supply initiation time, water level, drain initiation time, whether to rotate the drum, whether to operate the heating device, and the implementation time of the hot water course).

Note that the course time setting step S10 may be performed when the user selects the hot water course using the input unit as the controller 6 recognizes a preset hot water course time as the implementation time of the hot water course (briefly referred to as course time), or may be performed as a user input time, which is input by the user using the input unit (not illustrated) after selection of the hot water course, is set to the course time.

The course time setting step S10 may be performed before the first heating step S20.

In this case, the control method may further include, between the heating end step S40 and the step S53 of comparing the temperature of the wash water with the second reference temperature, a step S51 of judging whether the sum of the time taken in the first heating step S20 and the time taken in the heating end step S40 exceeds the course time.

When the sum of the time taken in the first heating step S20 and the time taken in the heating end step S40 exceeds the course time, the present invention ends the control of the laundry treatment apparatus without performing the second heating step S90.

However, when the sum of the time taken in the first heating step S20 and the time taken in the heating end step S40 does not exceed the course time, in the present invention, the second heating step S90 is performed starting from when the temperature of the wash water falls down below the second reference temperature until the temperature of the wash water reaches the first reference temperature (S91) or the course time has passed (S51).

In this way, the present invention enables the washing of laundry without change in the set course time for the hot water course, thereby preventing an increase in the operating time of the laundry treatment apparatus and a reduction in the lifespan of the heating device 9.

Figure 4:
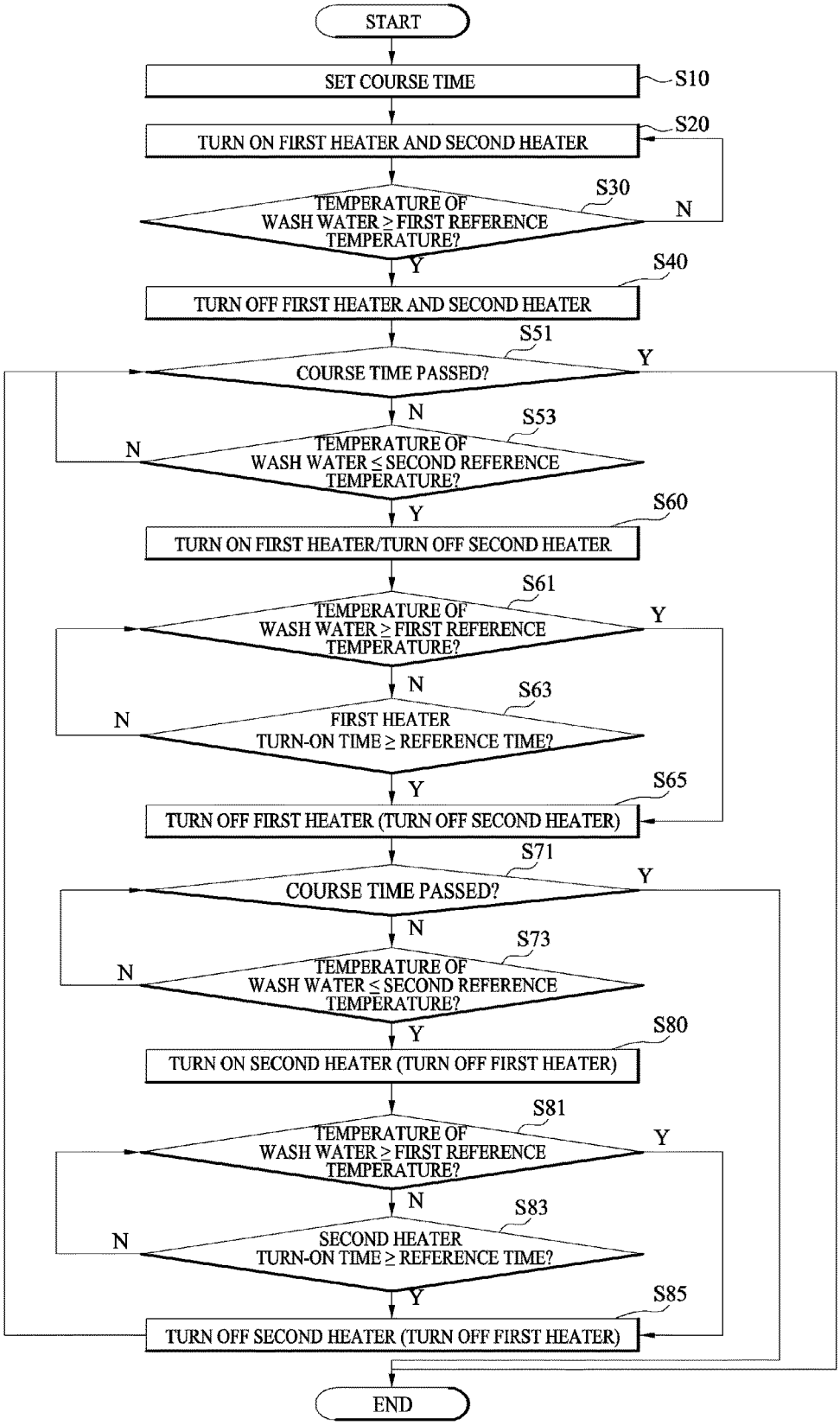
FIG. 4 illustrates another embodiment of a laundry treatment apparatus according to the present invention.

FIG. 4 illustrates another embodiment of the control method of the present invention. The present embodiment differs from the embodiment of FIG. 3 in terms of the criteria S61, S63, S81 and S83 for determining the operating time of the heaters in the second heating step and in terms of checking whether the course time has passed whenever one heater stops operation (S71 and S51).

Similarly, the control method according to the present embodiment includes the step S10 of setting the implementation time of the hot water course, the first heating step S20, and the heating end step S40 of ending the first heating step when the temperature of the wash water reaches the first reference temperature (S30). These steps are identical to the steps illustrated in FIG. 3 and, thus, a detailed description thereof will be omitted below.

After the heating end step S40, in the present embodiment, whether the sum of the time taken in the first heating step S10 and the time taken in the heating end step S40 exceeds the course time set in the hot water course implementation time setting step S10 is judged (S51).

When the sum of the time taken in the first heating step and the time taken in the heating end step exceeds the course time, the present embodiment ends the control of the laundry treatment apparatus 100. However, when the sum of the time taken in the first heating step and the time taken in the heating end step does not exceed the course time, the controller 6 judges, based on temperature data provided by the temperature sensing unit 7, whether the temperature of the wash water reaches the second reference temperature (S53).

When the temperature of the wash water reaches the second reference temperature, the control method of the present invention proceeds to the second heating step. Similarly, the second heating step of the present embodiment is performed by alternately operating the first heater 91 and the second heater 93.

That is, in the present embodiment, the second heating step includes a first heater operating step S60 of operating the first heater 91 without operating the second heater. The first heater operating step S60 may be performed as the controller 6 controls the first switch 95 to supply electric power to the first heater and controls the second switch 97 so as not to supply electric power to the second heater 93.

The first heater operating step S60 ends (S65) when the temperature of the wash water reaches the first reference temperature (S61) or when the time taken in the first heater operating step reaches a predetermined reference time (S63).

The end of the first heater operating step (S65) is performed as the controller 6 cuts the supply of electric power to the first heater 91 via the first switch 95.

Once the first heater operating step has ended, the control method of the present invention proceeds to a step S71 of judging whether the sum of the times taken in the respective previous steps S20, S30, S40, S51, S53, S60, S63 and S65 exceeds the course time set in the hot water course implementation time setting step S10.

When the sum of the times taken in the respective previous steps S20, S30, S40, S51, S53, S60, S63 and S65 exceeds the course time, the present embodiment ends the control of the laundry treatment apparatus 100.

However, when the sum of the times taken in the respective previous steps S20, S30, S40, S51, S53, S60, S63 and S65 does not exceed the course time, the control method of the present embodiment proceeds to a second heater operating step S80.

Note that, when the first heater operating step ends (S65) as the temperature of the wash water reaches the first reference temperature, the control method of the present invention proceeds to the second heater operating step S80 after whether the temperature of the wash water reaches the second reference temperature, which is set to be lower than the first reference temperature, is judged (S73).

This is because performing the second heater operating step S80 immediately after the first heater operating step ends (S65) may cause wasted electric power even when the first heater operating step ends (S65) as the temperature of the wash water reaches the first reference temperature.

The second heater operating step S80 is a step in which the controller 6 controls the second switch 97 and the first switch 95 to supply electric power to the second heater 93 without supplying electric power to the first heater 91.

Meanwhile, similarly, the second heater operating step S80 ends (S85) when the temperature of the wash water reaches the first reference temperature (S81) or when the time taken in the second heater operating step reaches the reference time (S83).

Once the second heater operating step has ended (S85), the control method of the present invention includes judging whether the sum of the times taken in the respective previous steps exceeds the time set in the hot water course time setting step S10 (S51) and, thereafter, repeats the above-described process (the process after Step S51).

While the control methods as described above focus on the laundry treatment apparatus including the two heaters 91 and 93 and the two switches 95 and 97, these control methods may be applied to other laundry treatment apparatuses including three or more heaters and switches equal in number to the heaters.

That is, the control method of the laundry treatment apparatus according to the present invention may include the first heating step S20 of heating wash water stored in the tub 2 by operating all of at least two heaters provided to heat the wash water, the heating end step S40 of ending the first heating step (stopping operation of all of the heaters) when the temperature of the wash water reaches a predetermined reference temperature, and the second heating step S90 of heating the wash water by alternately operating the heaters included in the laundry treatment apparatus when the temperature of the wash water falls down below the reference temperature after the first heating step ends (S40).

In this case, the respective steps may further include the steps described above with reference to FIGS. 3 and 4 and the order and features of the respective steps have been described above and, thus, a detailed description thereof will be omitted below.

In addition, in the case where the laundry treatment apparatus of the present invention includes a plurality of heaters (at least three heaters), one heater group and the other heater group may be alternately operated to heat wash water in the second heating step S90. The term "heater group" means at least two heaters to which electric power is supplied or to which the supply of electric power is stopped in the same period.

Although the exemplary embodiments have been illustrated and described as above, of course, it will be apparent to those skilled in the art that the embodiments are provided to assist understanding of the present invention and the present invention is not limited to the above described particular embodiments, and various modifications and variations can be made in the present invention without departing from the spirit or scope of the present invention, and the modifications and variations should not be understood individually from the viewpoint or scope of the present invention so long as they include constituent elements as set forth in the claims.

The invention claimed is:

1. A control method of a laundry treatment apparatus, the laundry treatment apparatus comprising a tub configured to provide a space for storage of wash water, at least two heaters configured to heat the wash water, and a temperature sensing unit configured to sense a temperature of the wash water stored inside the tub, the control method comprising:

a course time setting step of setting a course time of a hot water course, the hot water course including:

a first heating step of heating the wash water stored in the tub by supplying electric power to all of the heaters; and a heating end step of ending the first heating step when the temperature of the wash water measured by the temperature sensing unit reaches a predetermined reference temperature; and a determining step of determining whether a sum of an amount of time taken in the first heating step and an amount of time taken in the heating end step is shorter than the course time, wherein in the case where the sum of time is longer than the course time, the hot water course is terminated, and wherein in the case where the sum of time is shorter than the course time, a second heating step is performed, the second heating step of heating the wash water including alternately supplying electric power to the heaters when the temperature of the wash water measured by the temperature sensing unit falls down below the reference temperature, wherein the second heating step further includes:

a first heater operating step of supplying electric power to only one heater among the heaters;

a step of ending the first heater operating step when the temperature of the wash water reaches the predetermined reference temperature, wherein the step of ending the first heater operating step is also performed when the temperature of the wash water has not reached the predetermined reference temperature and a time taken in the first heater operating step reaches a reference time, wherein the reference time is set to a time to reach the course time, and wherein when it is determined that the course time has passed after the step of ending the first heater operating step, the hot water course is terminated.

2. The control method according to claim 1, wherein the first heating step, the heating end step, and the second heating step are performed via control of switches configured to connect the respective heaters to a power supply.

3. The control method according to claim 1, wherein the predetermined reference temperature includes a first reference temperature and a second reference temperature set to be lower than the first reference temperature, and wherein the heating end step is initiated when the temperature of the wash water reaches the first reference temperature, and wherein the second heating step is initiated when the temperature of the wash water is lower than the second reference temperature.

4. The control method according to claim 3, wherein the second heating step is performed as electric power is supplied to one heater for a predetermined reference time when a time during which electric power is supplied to the other heater reaches the reference time.

5. The control method according to claim 3, wherein the second heating step includes:

a first heater operating step of supplying electric power to only one heater among the heaters;

a step of ending the first heater operating step when the temperature of the wash water reaches the first reference temperature or when a time taken in the first heater operating step reaches a predetermined reference time;

a second heater operating step of supplying electric power to only the other heater among the heaters; and a step of ending the second heater operating step when the temperature of the wash water reaches the first reference temperature or when a time taken in the second heater operating step reaches the reference time.

6. The control method according to claim 5, wherein, in the case where the first heater operating step ends as the temperature of the wash water reaches the first reference temperature, the second heater operating step is initiated when the temperature of the wash water reaches the second reference temperature set to be lower than the first reference temperature.

7. A control method of a laundry treatment apparatus, the laundry treatment apparatus comprising a tub configured to provide a space for storage of wash water, a first heater and a second heater configured to heat the wash water, and a temperature sensing unit configured to sense a temperature of the wash water stored inside the tub, the control method comprising:

a course time setting step of setting a course time of a hot water course, the hot water course including:

a first heating step of heating the wash water stored in the tub by operating the first heater and the second heater; and a heating end step of ending the first heating step when the temperature of the wash water measured by the temperature sensing unit reaches a predetermined reference temperature; and a determining step of determining whether a sum of an amount of time taken in the first heating step and an amount of time taken in the heating end step is shorter than the course time, wherein in the case where the sum of time is longer than the course time, the hot water course is terminated regardless of the temperature of the wash water, and wherein in the case where the sum of time is shorter than the course time, a second heating step is performed, the second heating step of heating the wash water including alternately operating the first heater and the second heater when the temperature of the wash water measured by the temperature sensing unit falls down below the reference temperature, wherein the second heating step further includes:

a first heater operating step of supplying electric power to only one heater among the heaters;

a step of ending the first heater operating step when the temperature of the wash water reaches the predetermined reference temperature, wherein the step of ending the first heater operating step is also performed when the temperature of the wash water has not reached the predetermined reference temperature and a time taken in the first heater operating step reaches a reference time, wherein the reference time is set to a time to reach the course time, wherein when it is determined that the course time has passed after the step of ending the first heater operating step, the hot water course is terminated.

8. The control method according to claim 7, wherein the predetermined reference temperature includes a first reference temperature and a second reference temperature set to be lower than the first reference temperature, and wherein the heating end step is initiated when the temperature of the wash water reaches the first reference temperature, and wherein the second heating step is initiated when the temperature of the wash water is lower than the second reference temperature.

9. The control method according to claim 8, wherein the second heating step includes:

a first heater operating step of operating only the first heater;

a step of ending the first heater operating step when the temperature of the wash water reaches the predetermined first reference temperature or when a time taken in the first heater operating step reaches a predetermined reference time;

a second heater operating step of operating only the second heater; and a step of ending the second heater operating step when the temperature of the wash water reaches the first reference temperature or when a time taken in the second heater operating step reaches the reference time.

10. The control method according to claim 9, wherein, in the case where the first heater operating step ends as the temperature of the wash water reaches the first reference temperature, the second heater operating step is initiated when the temperature of the wash water reaches the second reference temperature set to be lower than the first reference temperature.

* * * * *